US006574836B1

(12) United States Patent
Steeber et al.

(10) Patent No.: US 6,574,836 B1
(45) Date of Patent: Jun. 10, 2003

(54) HINGE FRICTION DEVICE FOR BARREL-TYPE HINGES

(76) Inventors: Donald Edgar Steeber, 4609 Hadensville Farms La., Mineral, VA (US) 21401; Allen Frank Steeber, 12565 Auburn Mill Rd., Glen Allen, VA (US) 23059

( * ) Notice: Subject to any disclaimer, the term of this patent is extended or adjusted under 35 U.S.C. 154(b) by 0 days.

(21) Appl. No.: 10/002,533

(22) Filed: Nov. 16, 2001

(51) Int. Cl.[7] ..... E05C 17/64
(52) U.S. Cl. ..... 16/337; 16/341; 16/375
(58) Field of Search ..... 16/337, 342, 341, 16/322, 324, 325, 374, 375, 376, 377, 371

(56) References Cited

U.S. PATENT DOCUMENTS

| | | | | | |
|---|---|---|---|---|---|
| 703,626 | A | * | 7/1902 | Upson | 16/375 |
| 1,745,773 | A | * | 2/1930 | Sipe | 280/486 |
| 2,990,572 | A | * | 7/1961 | Schwartzberg | 16/375 |
| 3,178,762 | A | * | 4/1965 | Whiting | 16/375 |
| 3,602,942 | A | * | 9/1971 | Neff et al. | 16/375 |
| 4,630,333 | A | * | 12/1986 | Vickers | 16/338 |
| 4,949,427 | A | * | 8/1990 | Keller | 16/335 |
| 4,962,567 | A | * | 10/1990 | Dixon | 16/319 |
| 5,079,799 | A | * | 1/1992 | Rude et al. | 16/342 |
| 5,109,573 | A | * | 5/1992 | Sherman | 16/341 |
| 5,406,678 | A | * | 4/1995 | Kaden et al. | 16/342 |
| 5,727,289 | A | * | 3/1998 | Reder | 16/375 |

FOREIGN PATENT DOCUMENTS

| | | | |
|---|---|---|---|
| JP | 11062361 | A | * 3/1999 |

* cited by examiner

*Primary Examiner*—Chuck Y. Mah

(57) ABSTRACT

An apparatus and method for providing additional friction on a barrel-type hinge. A friction device is provided which provides lateral force to the exterior surface of the knuckles of a barrel-type hinge. Preferably, the lateral force is adjustable. The apparatus is a simple, easy to install, adjust, and use, solution to the problem of providing additional friction to hinges that swing freely.

18 Claims, 4 Drawing Sheets

HINGE FRICTION DEVICE FOR BARREL-TYPE HINGES

FIELD OF THE INVENTION

The present invention relates to the field of hinges; more specifically, to a barrel-type hinge with a friction providing device which applies a transverse force to the knuckles and pintle to cause the hinge to resist movement.

BACKGROUND OF THE INVENTION

Hinges have been known for several centuries. Before the advent of metalworking, they were constructed of leather, vegetable or fabric straps or bands. Today, similar hinges are formed from a connecting plastic strip, which is seen, e.g. in video rental boxes and the like. Ease and reliability of use is the key consideration in hinge construction.

The first metal hinges were simply wire that was bent double and linked together. These hinges, while stronger and more accurate in motion than their more primitive ancestors, still were far short of modern demands in both areas.

Metal smiths conceived the modern barrel hinge to solve those problems. A barrel hinge (sometimes called a butt-hinge because the pieces it joins end up "abutting" each other) includes two interlocking pieces, which have curved leaves wrapping around the same pivot pin. Such barrel hinges may be made of almost any metal, but in the real world iron and brass have proven to be the most popular choices. The hinge plates may be of various sizes and shapes (see, e.g. U.S. Pat. No. 5,099,562 illustrating folded plates).

Barrel hinges are commonly used in homes today to mount room or main entry doors, shutters, cabinetry doors, etc. In older houses, or in newer houses of less-than-optimal construction, the framing or leveling of the structure may be less than completely true. Thus, the doors may swing open or shut of their own volition. Or, a consumer may wish for a door to have some resistance to swing, e.g. to prevent a passing breeze from slamming the door to the closed position, with the concomitant trauma to the house and resident eardrums. A consumer may also wish a chest lid to remain in an upright position without needing a prop rod or the like.

However, a complete retrofitting of doors and lids to make them hang true would be inordinately expensive in most homes, and a total replacement of hinges with nonstandard hinges will lead to an aesthetically displeasing look unless a complete surface refinishing and repainting is undertaken.

An inexpensive, convenient, and simple solution to these desires is needed.

OBJECTS OF THE INVENTION

It is thus an object of the present invention to provide an inexpensive adaptation to barrel-type hinges to allow for friction to be imparted to the hinge.

It is a further object of the present invention to provide for an adjustable friction-imparting device for barrel-type hinges.

It is an additional object of the present invention to provide a simple, easily manufactured hinge modification to provide for the imparting of friction to a barrel-type hinge.

It is yet a further object of the present invention to provide a hinge adaptation, which is low profile and provides useful frictional additions.

It is another object of the present invention to provide a hinge modification that can be accomplished with a minimum of tools and simple parts.

It is still a further object to provide an adjustable friction-imparting device, which can be used to provide different levels of turning resistance in a hinge.

These, and other objects, will become readily apparent to one of skill in the art having regard for this disclosure.

SUMMARY OF THE INVENTION

Applicants have developed a novel device and method for preventing the swinging of hinged items by the application of a frictional element to the hinge. Friction-inducing elements are compressed against the outer surfaces of the knuckles of a barrel-type hinge, causing them to be frictionally engaged. In preferred embodiments, the frictional engagement is adjustable.

DESCRIPTION OF THE PREFERRED EMBODIMENT

As this invention may be more easily explained by reference to the attached drawings, it should be noted that the figures are representative and exemplary of the invention only, and should not be construed as limiting the scope of the invention in any way.

Figure 1:
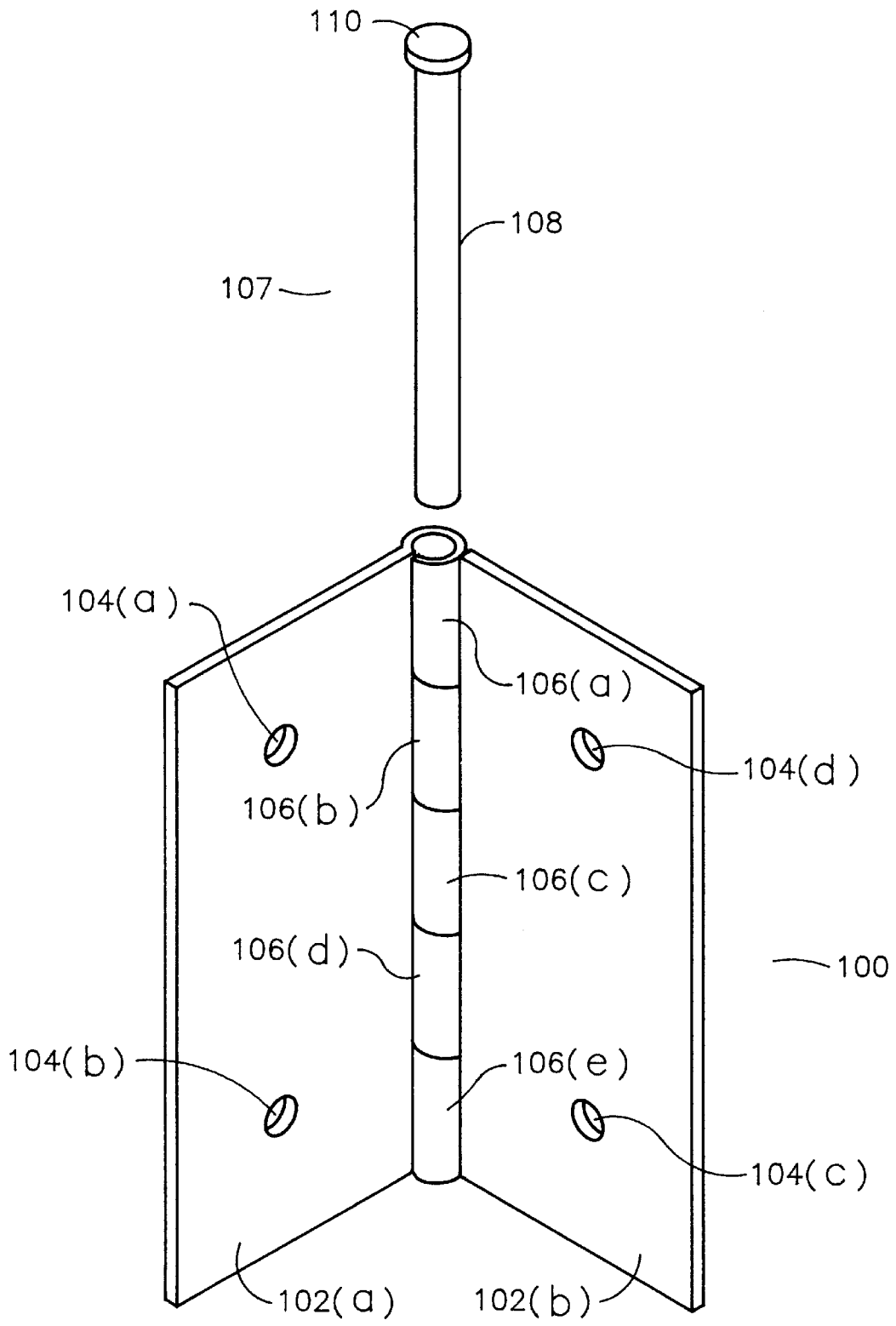
FIG. 1 (PRIOR ART)
FIG. 1 is a perspective view of a barrel-type hinge known in the prior art.

Turning now to FIG. 1, a prior art hinge, one may see that a barrel-type (sometimes called "butt") hinge 100 is formed from two leaves 102*a* and 102*b* into which are usually formed apertures or holes 104*a*, 104*b*, 104*c*, and 104*d* whereby the leaves are individually mounted to a door or frame or the like.

The leaves 102 of a butt or barrel hinge have interfitting, axially aligned knuckles 106*a*, 106*b*, 106*c*, 106*d*, and 106*e* along their opposed marginal edges for receiving a pintle or pin 107 therethrough, so that the leaves are swingable one with respect to the other on the pintle or pin 107.

The leaves 102(*a*) and 102(*b*) are generally rectangular, although any shape is possible. The holes 104(*a–d*) are of suitable construction and relative placement to mount the door, and are dependent on the type of installation (e.g. size, weight, profile, loads, etc.).

The axially aligned, spaced knuckles 106(*a–e*) may vary in number (with one being the minimum possible per leaf) and are adapted to receive therebetween or adjacent thereto a knuckle from on the opposed edge of said other leaf.

The axially aligned knuckles 106(*a–e*) receive the shank portion 108 of the pintle or pin 107 having a head 110. The head 110 keeps the pin from dropping out through the knuckles of the leaves due to the action of gravity thereupon. The pin or pintle should be at least as long as the axially aligned knuckles, but it may be variable in length to accommodate decorative caps or the like.

Figure 2:
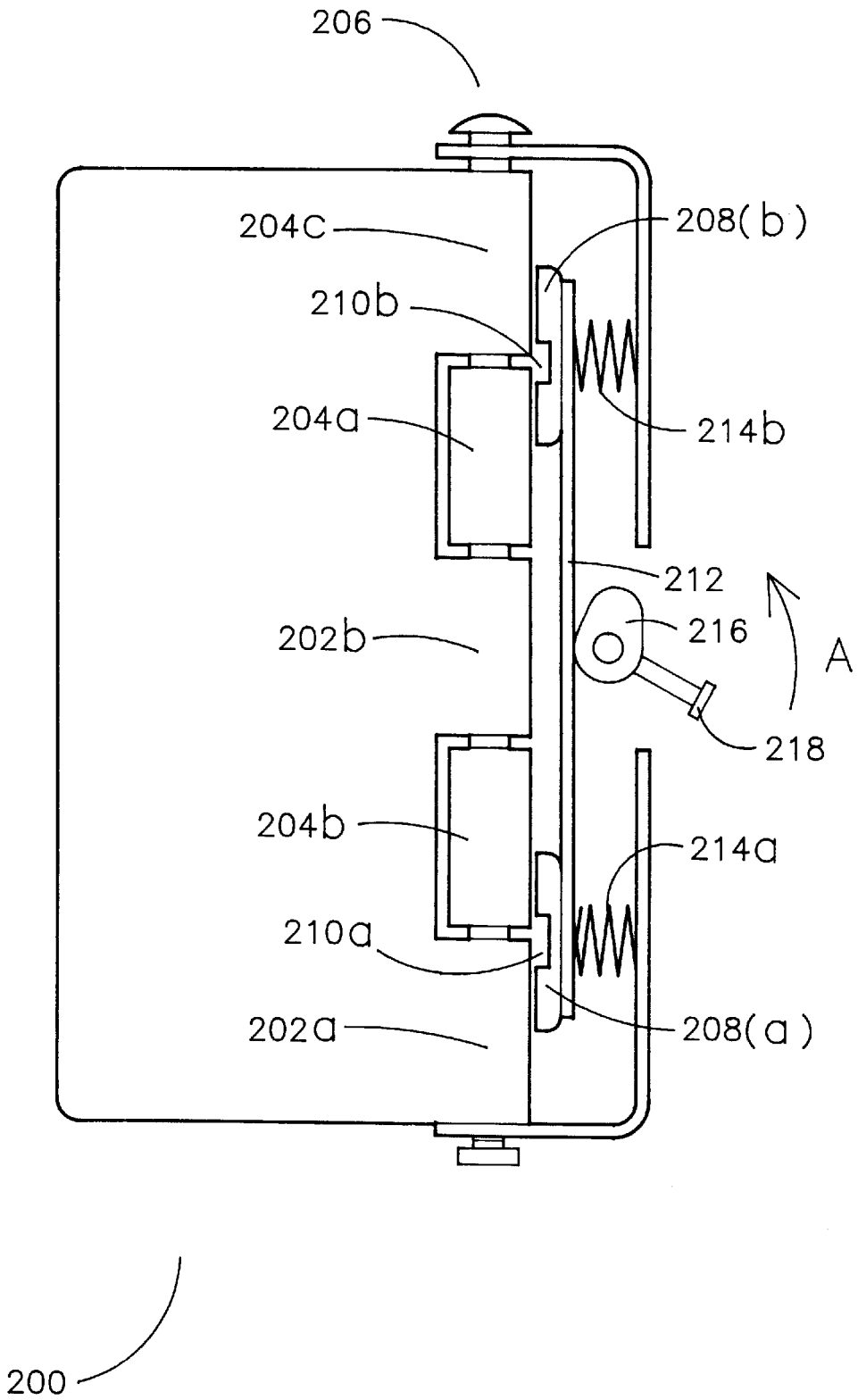
FIG. 2 is a cut-away side view of one embodiment of the present invention utilizing a cam apparatus.

Turning to FIG. 2, a preferred embodiment of the present invention is seen in a cut-away side view. The top leaf 200 is seen with multiple knuckles 202*a*, 202*b*, and 202*c*. The bottom leaf is visible only as knuckles 204*a* and 204*b*. The knuckles are axially aligned, and the pintle or pin 206 holds the entire hinge assembly together by passing through at least some, and preferably all, of the plurality of knuckles.

Hinges may be formed of leaves having one, two, three, or more knuckles on each leaf. The number and placement of knuckles depends upon the service demands, which may be laced upon the hinge. Presently, a hinge where one leaf has three knuckles, and one leaf has two knuckles axially aligned within the three knuckles of the first leaf is preferred.

Disposed immediately adjacent to the exterior of the knuckles are friction elements 208*a* and 208*b*. They are preferably formed with gaps 210*a* and 210*b*, which act to distribute the frictional load to both leaves of the hinge by ensuring contact is made against each knuckle. The gaps extend over the contiguous exterior surface edges of the knuckles where the leaves meet.

The frictional elements may be formed from a wide variety of materials, so long as they can generate sufficient frictional holding power for the particularly desired application when the compression of the adjusting mechanism or spring is considered.

A particularly preferred frictional engagement member comprises nylon, or rubber (natural or vulcanized). The frictional engagement member may also be formed from acrylonitrile-butadiene-styrene, a mixture of acrylonitrile-butadiene-styrene and nylon, acrylic, acrylonitrile, polychlorotrifluoroethylene, polytetrafluoroethylene, polytetrafluoroethylene reinforced with fibers, polyvinylidene fluoride, furan, phenolformaldehyde molding compounds, or polycarbonate. The frictional engagement member may also be polybutene terephthalate, polyethylene terephthalate, copolymers of polyethylene and ethylene, polyimide, polypropylene, polystyrene, styrene, polyurethane, silicone, or polyvinyl chloride. The frictional material should have enough lubricity to slide, yet continue to apply friction.

The frictional engagement devices may be a single pad, a pair of pads, or more, depending, again on the amount of friction required for the particular application. Presently, a pair of pads with gaps overriding the joints between the knuckles is preferred.

The frictional engagement devices have a generally flat surface, which is in sliding engagement with the exterior surface of the knuckles of the leaves. The surface may optionally be curved to more closely engage the outside knuckle, or it may be formed from sufficiently pliable material, e.g. a thermoplastic material, which will deform upon application of pressure to the surface of the material.

If there are a plurality of frictional engagement devices, they are preferably connected to maintain their spaced relationship. The connector is preferably a flexible strip 212 to which they are adhered by the application of a flexible epoxy or other bonding. The glue or affixation method chosen should have sufficient strength to resist the lateral frictional forces generated by the opening of the door, lid, closet, or item to which the hinge is attached. It should have some flexibility as well, as the frictional elements and flexible strip are generally somewhat flexible and a rigid bond could possible deteriorate over time.

The flexible strip can be removable and replaceable to provide differing levels of compressive force. It can be thickened or manipulated in a variety of ways to provide the desired level of compression (and thus transverse frictional engaging force) upon the knuckles and pin of the hinge. The flexible strip is preferably formed from steel, but various materials, e.g. plastic, etc. may be used provided they have the strength to maintain a compressive force without deforming over time. Presently preferred is 22-gauge spring steel.

The flexible strip can be provided with transverse compressive force by the action of springs 214*a* and 214*b* (in the event of a single friction element, a single spring would do). Optionally, a cam 216 may be actuated in the direction of arrow A to further compress the flexible strip and provide for further frictional resistance. Handle 218 may be removable for a low-profile appearance of the entire assembly.

Figure 3:
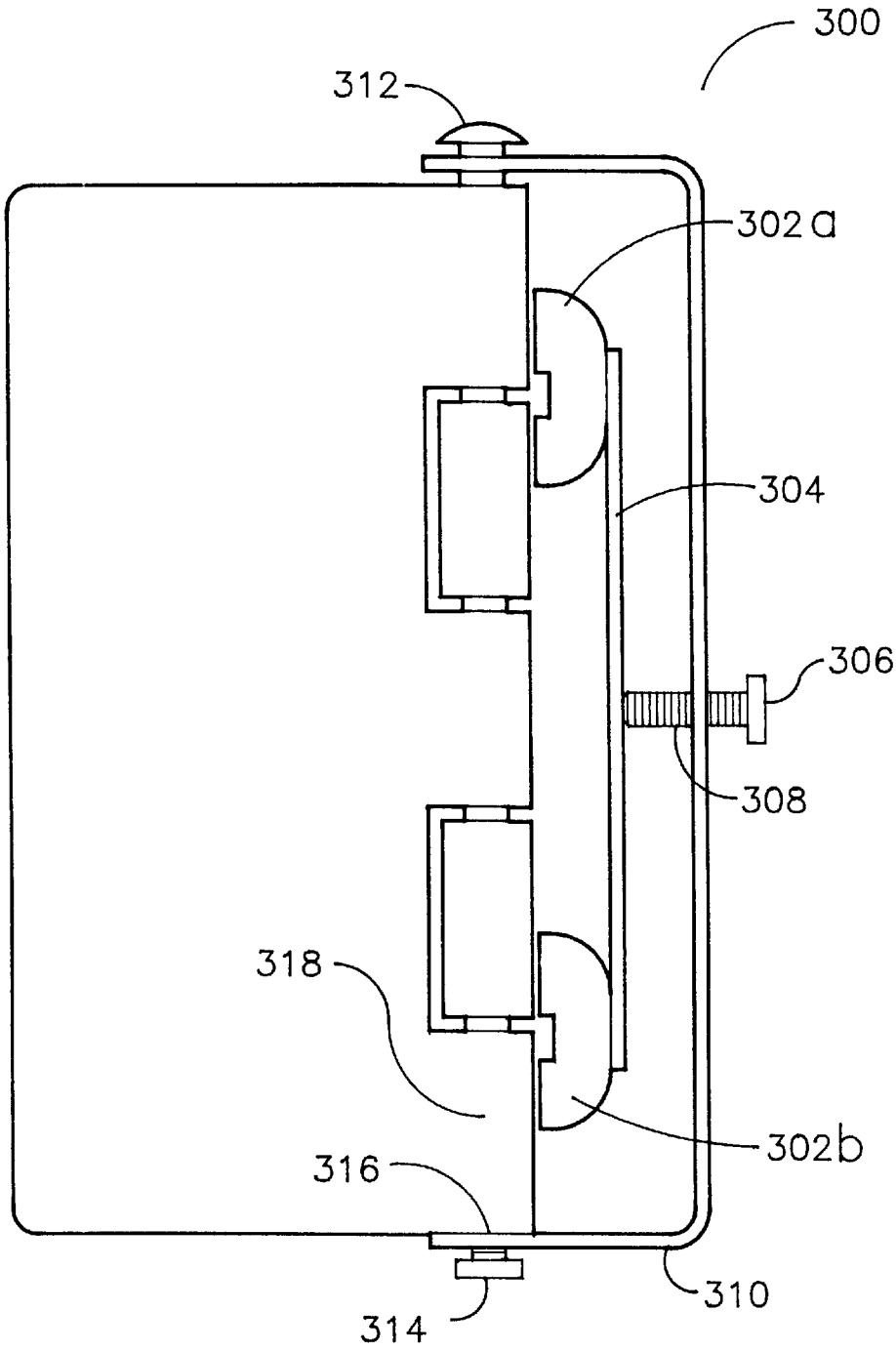
FIG. 3 is a cut-away side view of one embodiment of the present invention utilizing a setscrew apparatus.

With reference now to FIG. 3, a particularly preferred hinge embodiment 300 of the present invention is seen in cut-away perspective. The frictional engaging elements 302*a* and 302*b* are epoxied to the flexible strip 304. The frictional engagement elements may be much larger than shown, such that they fill in the ends of the housing and are maintained in their spaced relation by the flexible strip keeping them in location.

Adjustable compressive force is provided by a threaded screw or bolt 306, which is threadedly engaged into a correspondingly threaded hole 308. As the screw is further inserted, the compressive force upon the flexible strip, and thus the engaging frictional elements, is increased.

The entire assembly is enclosed in housing 310, which is held in place preferably by hinge pin 312. In one embodiment, hinge pin 312 is longer than an ordinary hinge pin to accommodate the additional size of housing 310. In another embodiment, a threaded screw 314 is matingly threaded into correspondingly threaded hole 316 and is thence screwed up into the knuckle 318 of one of the leaves.

Figure 4:
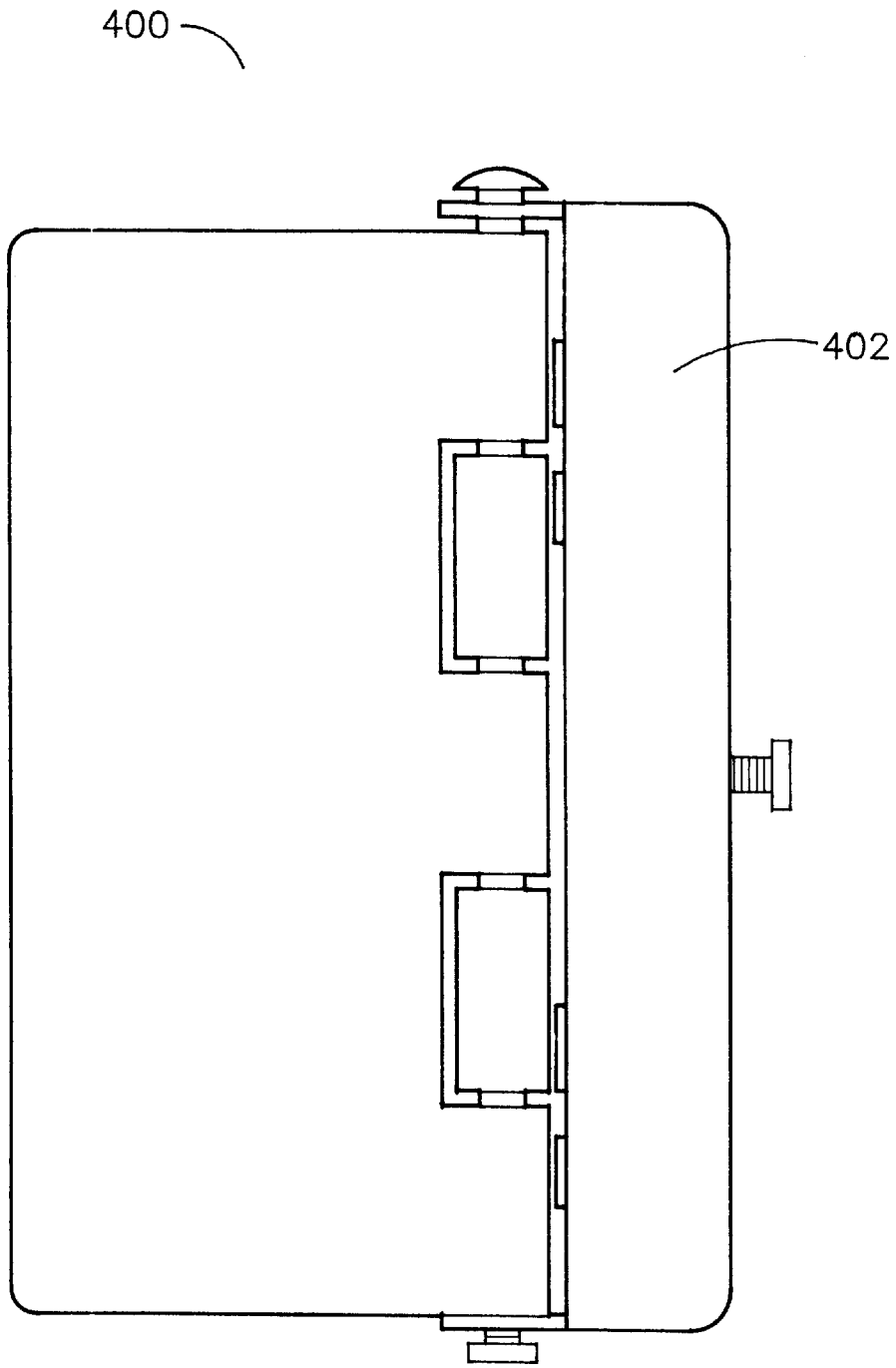
FIG. 4 is a side view of one embodiment of the present invention contained in a housing.

Turning now to FIG. 4, a side view of a preferred embodiment of the present hinge 400, the slim lines and low profile of the instant invention are clearly seen. A conventional hinge can be easily updated. The exterior housing 402 is hardly noticeable, and the necessary frictional adjustments may be made by the simple twisting of a screw mounted on the exterior of the housing.

The housing itself is preferably made from sheet metal, which is stamped and dies formed. Any apertures can be stamped and machined automatically, if they need to be threaded. The housing, however, may be made of any suitable material, metal, plastic, etc. Plastics would preferably be high-impact plastic and injection molded. Brass or brass look is presently preferred, as the majority of hinges, which could benefit from such an application of additional friction are brass or brass look.

Retrofitting existing hinges with the frictional device of the present invention is an extremely simple task, and may be accomplished with a single screwdriver. First, the hinge pin is removed. The exterior housing is then installed over the shank of the hinge. A new, longer hinge pin may be installed, or the original hinge pin may be reinstalled. Optionally, a screw in the bottom of the exterior housing may be tightened to secure the bottom of the housing in place. The frictional force is then adjusted by turning the set screw or cam located in the exterior of the housing.

While the invention has been described by reference to the preferred embodiment disclosed herein, the invention is subject to considerable modification and may be tailored to fit the needs of many suitable mounting needs without departing from the scope or spirit of the claims which are appended hereto.

Any patents, publications, or other art, which is listed or described herein, is expressly incorporated by reference.

While the present invention has been described with particular reference to embodiments above, those embodiments are exemplary only and should not be construed as limiting the scope of the invention in any way.

The invention is solely limited by the claims which follow.

What is claimed is:

1. A friction hinge assembly, comprising:

a hinge having at least two leaves and a hinge pin;

said at least two leaves having at least one segment on each of said leaves, which are adjacent one another and said hinge pin;

a frictional engagement member in contact with at least one of said segments from each leaf;

said frictional engagement member being held against said segments by a retaining device connected to said hinge; and wherein said frictional engagement member includes a surface gap, which extends across said adjacent segments.

2. A friction hinge assembly as claimed in claim 1, wherein said hinge is a barrel-type hinge.

3. A friction hinge as claimed in claim 1, wherein said frictional engagement member comprises a resilient member.

4. A friction hinge as claimed in claim 3, wherein said frictional engagement member comprises a thermoplastic material.

5. A friction hinge as claimed in claim 4, said frictional engagement member comprises nylon or rubber.

6. A friction hinge as claimed in claim 4, wherein said frictional engagement member is formed from material selected from the group consisting of acrylonitrile-butadiene-styrene, a mixture of acrylonitrile-butadiene-styrene and nylon, acrylic, acrylonitrile, polychlorotrifluoroethylene, polytetrafluoroethylene, polytetrafluoroethylene reinforced with fibers, polyvinylidene fluoride, furan, phenolformaldehyde molding compounds, and polycarbonate.

7. A friction hinge as claimed in claim 4, wherein said frictional engagement member is formed from material selected from the group consisting of polybutene terephthalate, polyethylene terephthalate, copolymers of polyethylene and ethylene, polyimide, polypropylene, polystyrene, styrene, polyurethane, silicone, and polyvinyl chloride.

8. A friction hinge assembly, comprising:

a hinge having at least two leaves and a hinge pin;

said at least two leaves having at least one segment on each of said leaves and being rotatable about said hinge pin;

a frictional engagement member in contact with at least one of said segments from each leaf;

said frictional engagement member being held against said segments by a retaining device connected to said hinge; and wherein said frictional engagement member comprises a plurality of frictional engagement elements.

9. A friction hinge as claimed in claim 8, wherein said plurality of frictional engagement elements are connected by a flexible strip.

10. A friction hinge as claimed in claim 9, wherein said flexible strip is connected to an adjustment device connected to the retaining device.

11. A friction hinge as claimed in claim 10, wherein said adjustment device is a cam.

12. A friction hinge as claimed in claim 10, wherein said adjustment device is a set screw.

13. A friction hinge as claimed in claim 1, wherein said retaining device is a housing which is formed with openings in either end, said hinge pin fits into one aperture, and a screw is threadedly engaged into said other aperture.

14. A friction hinge as claimed in claim 13, wherein said hinge includes a friction adjustment device comprising a set screw which is threadedly engaged into an additional aperture formed into said housing.

15. A method of providing additional friction to a barrel-type hinge having two leaves with knuckles and a hinge pin through the knuckles, comprising:

removing the hinge pin from the knuckles;

placing a friction-enhancing device against the knuckles;

securing the friction-enhancing device against the knuckles by reinserting the hinge pin; and inserting a screw into the friction-enhancing device to further secure it to the hinge.

16. A method as claimed in claim 15, further comprising adjusting the amount of friction provided.

17. A method as claimed in claim 16, wherein the adjusting comprises turning a set screw or a cam.

18. A hinge adjustment mechanism for adjusting the friction of a pre-existing hinge assembly having at least two leaves and segments on each of said leaves which are adjacent to one another and which rotate about a hinge pin, comprising:

a frictional engagement member for contacting at least one of said segments from each leaf;

said frictional engagement member being held against said segments by a retaining device for connecting to said hinge, and designed for connection with said hinge; and wherein said frictional engagement member comprises a plurality of frictional engagement elements.

* * * * *